US008863526B2

(12) United States Patent
Hadley et al.

(10) Patent No.: US 8,863,526 B2
(45) Date of Patent: Oct. 21, 2014

(54) FUEL INJECTOR

(75) Inventors: Mark Allan Hadley, Greer, SC (US); Rajani Kumar Akula, Karnataka (IN); Jayaprakesh Natarajan, Greer, SC (US); Chetan Babu Velkur, Karnataka (IN)

(73) Assignee: General Electric Company, Schenectady, NY (US)

( * ) Notice: Subject to any disclaimer, the term of this patent is extended or adjusted under 35 U.S.C. 154(b) by 952 days.

(21) Appl. No.: 13/007,227

(22) Filed: Jan. 14, 2011

(65) Prior Publication Data

US 2012/0180491 A1 Jul. 19, 2012

(51) Int. Cl.
*F23R 3/28* (2006.01)
*F23R 3/34* (2006.01)

(52) U.S. Cl.
CPC ..... *F23R 3/286* (2013.01); *F23R 3/346* (2013.01)
USPC ..... 60/737

(58) Field of Classification Search
CPC ..... F02C 7/22; F23D 14/62; F23D 14/64; F23D 14/00; F23R 3/286; F23R 3/28; F23R 3/34; F23R 3/346; F23R 3/30; F23R 3/32
USPC ..... 60/39.463, 39.49, 742, 746, 733, 737, 60/738, 739, 740, 747; 239/419.3, 416.4, 239/416.5, 421, 423, 424.5; 137/9
See application file for complete search history.

(56) References Cited

U.S. PATENT DOCUMENTS

| | | | | | |
|---|---|---|---|---|---|
| 3,531,937 | A | * | 10/1970 | Sneeden | 60/738 |
| 4,100,733 | A | * | 7/1978 | Striebel et al. | 60/39.463 |
| 5,584,684 | A | * | 12/1996 | Dobbeling et al. | 431/285 |
| 5,881,756 | A | * | 3/1999 | Abbasi et al. | 137/9 |
| 6,047,550 | A | | 4/2000 | Beebe | |
| 6,192,688 | B1 | | 2/2001 | Beebe | |
| 6,868,676 | B1 | | 3/2005 | Haynes | |

FOREIGN PATENT DOCUMENTS

WO 2009038652 A2 3/2009

* cited by examiner

*Primary Examiner* — Phutthiwat Wongwian
*Assistant Examiner* — Alain Chau
(74) *Attorney, Agent, or Firm* — Cantor Colburn LLP

(57) ABSTRACT

A fuel injector is provided and includes a first tube, having first and second opposing ends, which is supplied with fuel, and one or more second tubes disposed within the first tube, each of the one or more second tubes being supplied with air and having sidewalls defining injection holes through which the fuel enters the one or more second tubes to mix with the air, and an outlet end of the sidewalls corresponding to the second end of the first tube.

12 Claims, 2 Drawing Sheets

FUEL INJECTOR

BACKGROUND OF THE INVENTION

The subject matter disclosed herein relates to a late lean fuel injector.

In gas turbine engines, combustible materials are combusted in a combustor and the high energy fluids produced by the combustion are directed to a turbine via a transition piece. In the turbine, the high energy fluids aerodynamically interact with and drive rotation of turbine blades in order to generate electricity. The high energy fluids are then transmitted to further power generation systems or exhausted as emissions along with certain pollutants, such as oxides of nitrogen (NOx) and carbon monoxide (CO). These pollutants are produced due to non-ideal consumption of the combustible materials.

Recently, efforts have been undertaken to achieve more ideal consumption of the combustible materials to thereby reduce the amounts of pollutants in the emissions. These efforts include the development of fuel injection whereby combustible materials are injected into the transition piece to mix with the main flow of high energy fluid moving through the transition piece toward the turbine. This leads to increased temperature and energy of the high energy fluids and more ideal consumption of fuel, which correspondingly reduces the pollutant emissions.

BRIEF DESCRIPTION OF THE INVENTION

According to one aspect of the invention, a fuel injector is provided and includes a first tube, having first and second opposing ends, which is supplied with fuel, and one or more second tubes disposed within the first tube, each of the one or more second tubes being supplied with air and having sidewalls defining injection holes through which the fuel enters the one or more second tubes to mix with the air, and an outlet end of the sidewalls corresponding to the outlet end of the first tube.

According to another aspect of the invention, a fuel injector is provided and includes a first tube, having first and second opposing ends, which is supplied with fuel and a plurality of second tubes disposed within the first tube, each of the plurality of second tubes being supplied with air and having sidewalls defining injection holes through which the fuel enters each of the plurality of second tubes to mix with the air, and an outlet end opening through the second end of the first tube, a number of the injection holes of each one of the plurality of second tubes being different from a number of the injection holes of at least another one of the plurality of second tubes.

According to yet another aspect of the invention, a gas turbine engine is provided and includes a vessel having a liner defining an interior through which a main flowpath is defined from an upstream location to a downstream location and a fuel injector, including a first tube having first and second opposing ends, which is supplied with fuel and connectable with the vessel liner and a plurality of second tubes disposed within the first tube, each of the plurality of second tubes being supplied with air and having sidewalls defining injection holes through which the fuel enters each of the plurality of second tubes to mix with the air, and an outlet end opening into the vessel interior, a number of the injection holes of each one of the plurality of second tubes being different from a number of the injection holes of at least another one of the plurality of second tubes.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
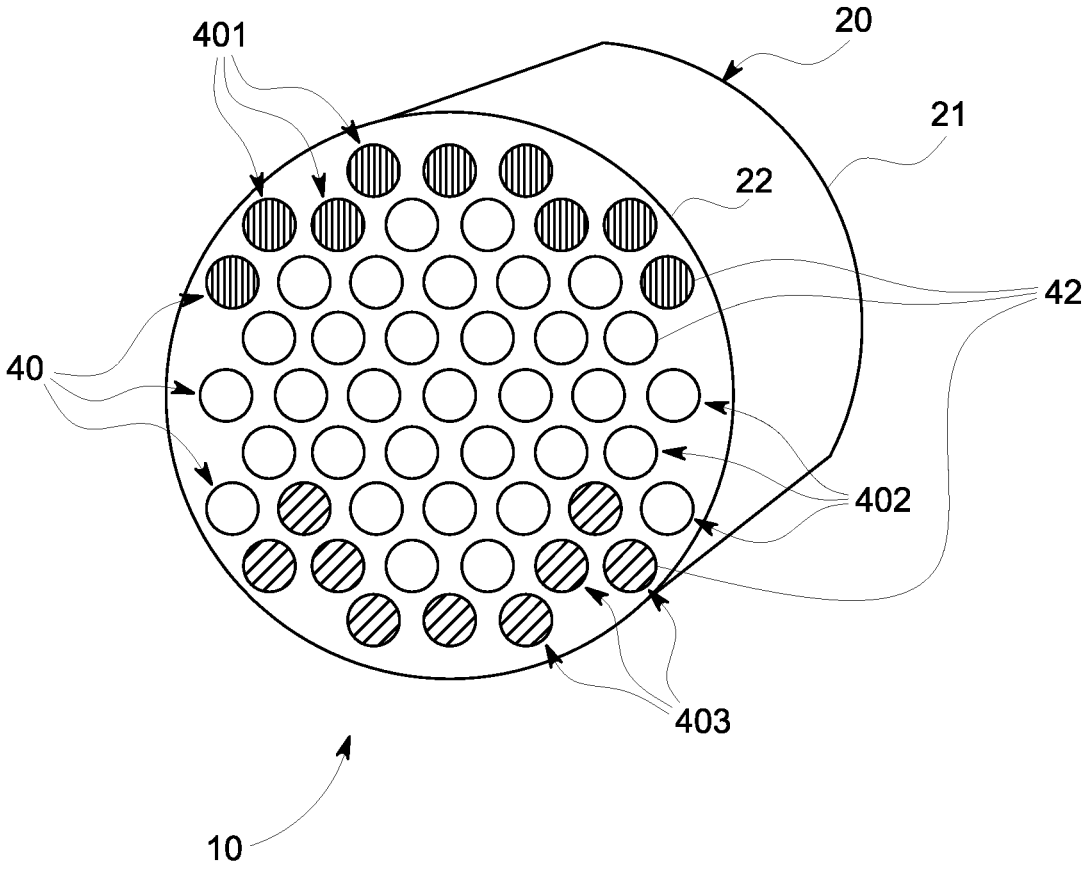
FIG. 1 is a perspective view of a fuel injector.
Figure 2:
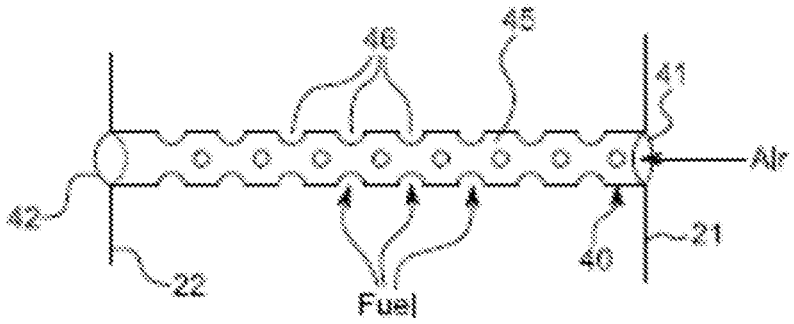
FIG. 2 is an enlarged side view of a second tube of the fuel injector of FIG. 1.
Figure 3:
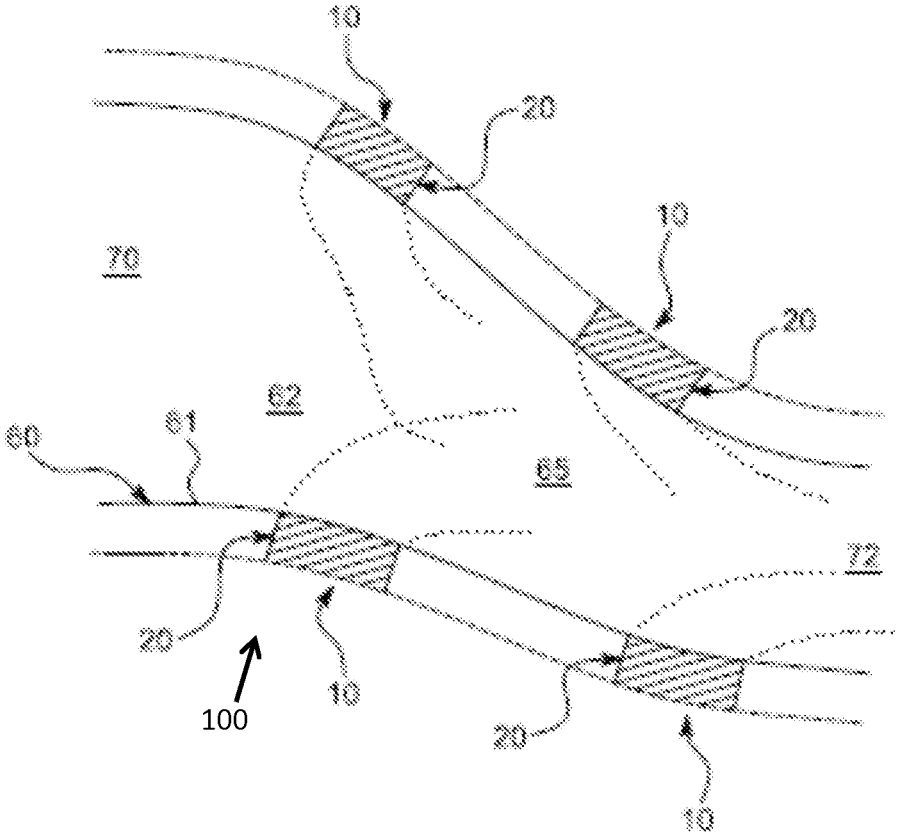
FIG. 3 is a side view of plural fuel injectors connected with a vessel.

With reference to FIGS. 1-3, a fuel injector 10 is provided and includes a first tube 20, which is supplied with fuel, and one or more of a plurality of second tubes 40 supplied with air. The first tube 20 is substantially cylindrical with a first end 21 and a second opposite end 22 and is connectable with a vessel 60 of, for example, a gas turbine engine 100 (see FIG. 3). The vessel 60 may be a liner 61 or a transition piece that is fluidly interposed between a combustor and a turbine such that the liner 61 defines an interior 62 through which a main flowpath 65 is defined from an upstream end 70 to a downstream end 72. High energy and high temperature fluids produced by combustion within the combustor flow along the flowpath 65 with the fuel injected into the flowpath 65 by the plurality of second tubes 40 in order to increase power generation within the turbine.

The fuel injector 10 provides for staged combustion processes whereby some fraction of available fuel and air are combusted in a first stage of combustion and the fuel injector 10 provides fuel and air to a later stage or stages of combustion. In those later stage(s) of combustion, the products of the first stage combustion participate in the combustion of the fuel and the air provided by the fuel injector 10. By reusing the products of combustion of the first stage in the later stage(s) in this manner, pollutant emission amounts can be decreased. The degree of this decrease can be amplified by use of multiple fuel injectors 10.

The plurality of second tubes 40 is disposed within the first tube 20 such that respective longitudinal axes of each of the plurality of second tubes 40 is substantially aligned with the longitudinal axis of the first tube 20. Thus, each of the plurality of second tubes 40 has a first end 41 corresponding in location generally to the first end 21 of the first tube 20, an outlet end 42 corresponding in location to the second end 22 of the first tube 20 and sidewalls 45. The outlet end 42 is disposed at an end of the sidewalls 45 that also correspond in location to the second end 22 of the first tube 20. The sidewalls 45 define a plurality of injection holes 46 through which the fuel supplied to the first tube 20 is communicable with each of the plurality of second tubes 40 to mix with the air supplied to the plurality of second tubes 40. The first and second ends 21 and 22 of the first tube 20 are closed but for openings associated with the first and second ends 41 and 42 of each of the plurality of second tubes 40. A mixture of fuel and air may be, thus, provided to the main flowpath 65 by way of the openings of each of the plurality of second tubes 40.

In accordance with a further embodiment, the first tube 20 may be plural in number and disposed at various axial and circumferential locations about the vessel 60. In this case, a plurality of second tubes 40 is disposed within each one of the plural first tubes 20, as shown in FIG. 3.

A number of the plurality of injection holes 46 of each one of the plurality of second tubes 40 may be different from a number of the plurality of injection holes 46 of at least another one of the plurality of second tubes 40. Particularly, a number of the plurality of injection holes 46 of each one of the plurality of second tubes 40 may be predefined in accordance with a position thereof within the first tube 20. The number of the plurality of injection holes 46 of each one of the plurality of second tubes 40 may also be predefined in accordance with a position thereof with respect to at least another second tube(s) 40.

In this way, the fuel injector 10 can be designed as a micro mixer with fuel/air ratios for each of the plurality of second tubes 40 that is different in some or every second tube 40 in a manner that is tailored to selective production of oxides of nitrogen (NOx) and which provides for higher turndown due to air bypass of the micro mixer when it is de-energized. That is, the fuel injector 10 can be designed to decrease NOx production by sizing fuel quantities per a selected unit of time.

In accordance with embodiments and, with reference to FIG. 1, the number of the plurality of injection holes 46 of each one of the plurality of second tubes 40 may decrease along a direction of flow along the flowpath 65 and may remain substantially uniform in a direction perpendicular to the direction of flow along the flowpath 65. The decrease may be gradual or incremental. That is, the upstream second tubes 401 proximate to the upstream end 70 may have the highest number of injection holes 46, the downstream second tubes 403 proximate to the downstream end 72 may have the least number of injections holes 46 and the intermediate second tubes 402 may have an intermediate number of injections holes 46. As a result, the upstream second tubes 401 may deliver a fuel/air mixture to the main flowpath 65 having a relatively high or low fuel/air ratio, the downstream second tubes 403 may deliver a fuel/air mixture having a relatively low or high fuel/air ratio and the intermediate second tubes 402 may deliver a fuel/air mixture having an intermediate, high or low fuel/air ratio. With this configuration, the fuel delivered to the main flowpath 65 by way of the upstream second holes 40 will have the greatest chance to propagate toward and into a radial central region of the vessel 60.

A number of the intermediate second tubes 402 may be greater or lesser than respective numbers of the upstream second tubes 401 and the downstream second tubes 403. Thus, the number of second tubes 40 delivering a fuel/air mixture having an intermediate fuel/air ratio will be relatively large and will facilitate use of the fuel injector 10 with various types of vessels and in various types of operational conditions.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel injector, comprising:

a first tube, having first and second opposing ends, which is supplied with fuel and connectable with a vessel at the second end thereof; and plurality of second tubes disposed within the first tube, each of the plurality of second tubes being supplied with air and having:

sidewalls defining injection holes through which the fuel enters each of the plurality of second tubes to mix with the air, and an outlet end of the sidewalls corresponding to the second end of the first tube, wherein a main flowpath is defined through the vessel from an upstream location to a downstream location and a number of the injection holes of each one of the plurality of second tubes decreases along a direction of flow along the flowpath.

2. The fuel injector according to claim 1, wherein a number of the injection holes of each one of the plurality of second tubes remains substantially uniform along a direction perpendicular to a direction of flow along the flowpath.

3. The fuel injector according to claim 1, wherein the decrease in the number of injection holes is incremental.

4. The fuel injector according to claim 3, wherein a number of the ones of the plurality of second tubes having an intermediate number of injection holes is greater than numbers of the ones of the plurality of second tubes having high and low numbers of injection holes.

5. A fuel injector, comprising:

a first tube, having first and second opposing ends, which is supplied with fuel; and a plurality of second tubes disposed within the first tube, each of the plurality of second tubes being supplied with air and having sidewalls defining injection holes through which the fuel enters each of the plurality of second tubes to mix with the air, and an outlet end opening through the second end of the first tube, a number of the injection holes of each one of the plurality of second tubes being different from a number of the injection holes of at least another one of the plurality of second tubes.

6. The fuel injector according to claim 5, wherein a number of the injection holes of each one of the plurality of second tubes remains substantially uniform along a direction perpendicular to a direction of flow along the flowpath.

7. The fuel injector according to claim 5, wherein the first tube is connectable with a vessel at the outlet end thereof, a main flowpath being defined through the vessel from an upstream location to a downstream location.

8. The fuel injector according to claim 7, wherein a number of the injection holes of each one of the plurality of second tubes decreases along a direction of flow along the flowpath.

9. The fuel injector according to claim 8, wherein the decrease in the number of injection holes is incremental.

10. The fuel injector according to claim 9, wherein a number of the ones of the plurality of second tubes having an intermediate number of injection holes is greater than numbers of the ones of the plurality of second tubes having high and low numbers of injection holes.

11. A gas turbine engine, comprising:

a vessel having a liner defining an interior through which a main flowpath is defined from an upstream location to a downstream location; and a fuel injector, including a first tube having first and second opposing ends, which is supplied with fuel and connectable with the vessel liner and a plurality of second tubes disposed within the first tube, each of the plurality of second tubes being supplied with air and having sidewalls defining injection holes through which the fuel enters each of the plurality of second tubes to mix with the air, and an outlet end opening into the vessel interior, a number of the injection holes of each one of the plurality of second tubes being different from a number of the injection holes of at least another one of the plurality of second tubes.

12. The gas turbine engine according to claim 11, wherein a number of the injection holes of each one of the plurality of second tubes decreases along a direction of flow along the flowpath.

* * * * *

UNITED STATES PATENT AND TRADEMARK OFFICE

CERTIFICATE OF CORRECTION

PATENT NO. : 8,863,526 B2
APPLICATION NO. : 13/007227
DATED : October 21, 2014
INVENTOR(S) : Hadley et al.

It is certified that error appears in the above-identified patent and that said Letters Patent is hereby corrected as shown below:

On the title page item (75), under "Inventors", in Column 2, Line 3, delete "Jayaprakesh Natarajan," and insert -- Jayaprakash Natarajan, --, therefor.

In the Claims,

In Column 4, Line 9, in Claim 1, delete "plurality" and insert -- a plurality --, therefor.

Signed and Sealed this
Nineteenth Day of May, 2015

Michelle K. Lee

Michelle K. Lee
*Director of the United States Patent and Trademark Office*